United States Patent [19]

Ball et al.

[11] Patent Number: 4,658,803

[45] Date of Patent: Apr. 21, 1987

[54] GAS-FIRED WATER HEATERS

[75] Inventors: Geoffrey Ball, Epsom; Robin Galliver, London; Martin White, Kingston-upon-Thames, all of England

[73] Assignee: British Gas Corporation, London, England

[21] Appl. No.: 791,161

[22] Filed: Oct. 24, 1985

[30] Foreign Application Priority Data

Nov. 7, 1984 [GB] United Kingdom ..... 8428166

[51] Int. Cl.[4] ..... F24H 1/10

[52] U.S. Cl. ..... 126/355; 126/359; 110/215; 122/5.5 A; 122/31 R

[58] Field of Search ..... 126/355, 359, 360 A, 126/360 R; 237/17, 16, 57, 59, 62; 122/5.5 A, 44 A, 155 A, 14, 31 R, 31 A; 159/4.02, 16.1, 16.2; 261/94, 98, DIG. 72, 126; 110/215

[56] References Cited

U.S. PATENT DOCUMENTS 884,223 4/1908 Shipley ..... 126/355 X
1,341,048 5/1920 Drevet ..... 126/359
3,648,682 3/1972 Bougard ..... 126/359
3,826,240 7/1974 Miyahara ..... 126/359 X
4,275,708 6/1981 Wood ..... 126/355
4,380,215 4/1983 Mendelson ..... 122/155 A X

FOREIGN PATENT DOCUMENTS 506731 5/1976 U.S.S.R. ..... 126/5

*Primary Examiner*—Randall L. Green
*Attorney, Agent, or Firm*—Watson, Cole, Grindle & Watson

[57] ABSTRACT

A compact, gas-fired water heater in which a reservoir of bulk water is indirectly heated by a gas burner-fired immersion tube and directly heated by mutual contact between the hot flue gases from the immersion tube outlet and feed water droplets as they pass each other in contra-flow through the apertures in a plurality of plates and through a packed bed of graded solid particles or Rashig rings. The packed bed may also include suitable chemicals for modifying the quality of the stored water. One or more calorifiers may be located in the reservoir with limited direct heat conduction contact with the immersion tube.

7 Claims, 1 Drawing Figure

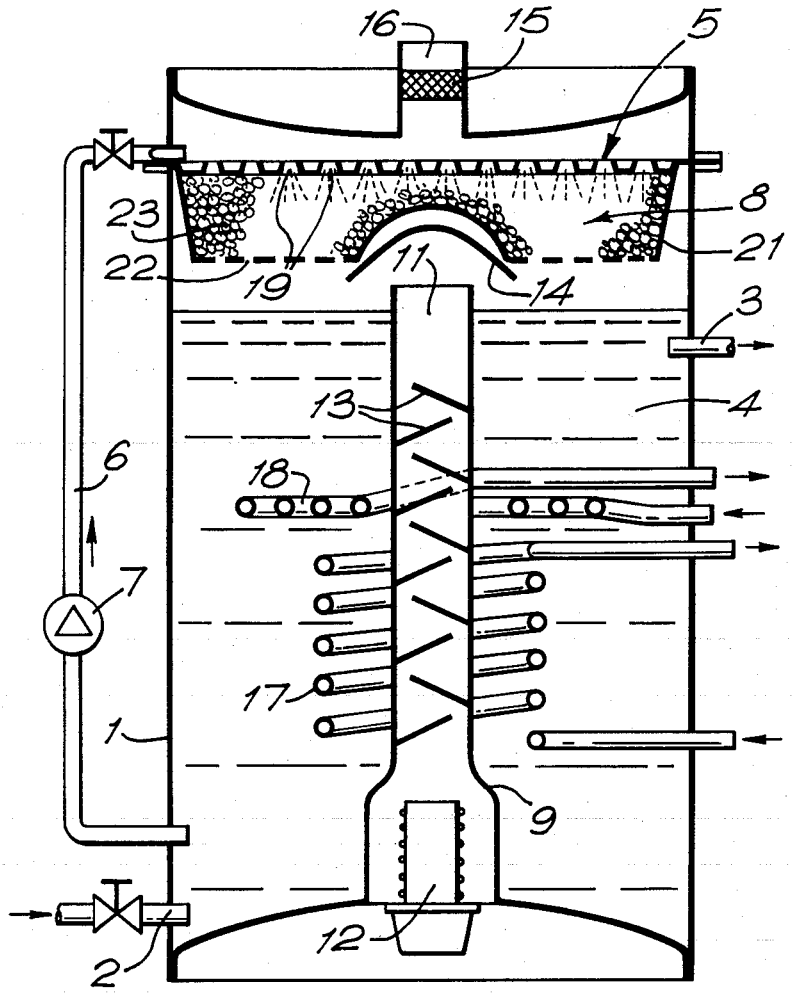
16
15
5
23
8
21
22
19
11
14
3
13
4
6
18
7
17
1
9
12
2

GAS-FIRED WATER HEATERS

BACKGROUND OF THE INVENTION

1. Field of the Invention

This invention relates to gas-fired water heaters, and more particularly to gas-fired water heaters of the kind in which heat exchange takes place by direct contact of the combustion product gases from a gas burner with the feed water.

2. The Prior Art

In U.S. Pat. No. 4,530,347, commonly owned herewith, there is described a compact, gas-fired water heater comprising a casing defining a reservoir for collecting water supplied as streams by a water distribution means located above the reservoir, an inlet for feed water to the water distribution means a heat exchanger located within the reservoir to receive hot product gases of combustion from a gas burner for heat exchange with the water in the reservoir, outlet means from the heat exchanger for discharging the gases towards the water distribution means, heat transfer means located between the reservoir and the water distribution means for providing heat transfer between the gases and the water issuing from the water distribution means, and an exhaust gas outlet located above the water distribution means.

SUMMARY OF THE INVENTION

In order to still further improve the efficiency of such a water heater and in accordance with the present invention, in a compact gas-fired water heater of the kind disclosed in U.S. Pat. No. 4,530,347, the heat transfer means is provided by saturator means located between the water distribution means and the reservoir, the saturator means having a geometry which minimises the pressure drop of the hot product gases therethrough but which has a high wettable surface area for maximum exchange of heat from the gases to the feed water passing thereover.

The saturator means may consist of a packed bed of suitably shaped material, for example, graded solid particles or Rashig rings. The material would be inert in this environment, for example, stainless steel, glass or aggregate, and could conveniently be packed into a container having a perforate base plate through which the feed water will pass.

In order to modify the quality of the water being drawn off from the reservoir, suitable chemicals may be added to or mixed with the inert saturator means, which chemicals, among other desirable functions, would reduce the nitrate and nitrite levels in the water. Chemicals such as anion exchange resins would be suitable.

As an alternative to including the chemicals in the saturator means, a separate removable and renewable pack of chemicals may be located between the water distribution means and the reservoir.

Conveniently, the water heater in accordance with the invention may include calorifiers for providing some space or other heating by extracting some heat from the stored hot water in the reservoir and possible augmented by heat transferred by direct, but preferably limited, heat conduction path contact between the calorifiers and the heat exchanger which receives the hot product gases of combustion from the gas burner. This limited heat conduction path can, for example, be achieved by the number and area of metallic joints between the heat exchanger and the calorifiers which may be in the form of coiled tubes disposed about a tubular combustion chamber constituting said heat exchanger.

The flow of hot product gases from the burner to the exhaust outlet may be by natural draught or may be assisted by a fan. The fan may be located at the combustion air inlet to the burner or alternatively at the exhaust gas outlet.

By way of example, an embodiment of the invention will now be further described with reference to the accompanying FIGURE.

DESCRIPTION OF THE FIGURE

The attached FIGURE shows a schematic sectional view of a gas-fired water heater according to a preferred embodiment of the present invention.

DETAILED DESCRIPTION OF THE PREFERRED EMBODIMENT

Referring to the FIGURE, the water heater shown is designed for domestic heating to provide hot water for domestic purposes, for example, washing and for space heating. The heater comprises an outer casing 1 having a main cold water feed inlet 2 arranged to replenish any water drawn off from a hot water outlet 3 from the reservoir of water 4 contained within the casing. Within the upper part of the casing is mounted a water distribution plate 5 to which water from the reservoir 4 is fed by recirculation through a pipe 6 by a pump 7. Beneath the plate 5 is supported a heat transfer means in the form of a saturator unit 8. Projecting vertically upwards from the bottom of the casing is an immersion tube heat exchanger 9 in the form of a combustion chamber having an outlet 11 for the passage of hot product gases of combustion from a fan-assisted premixed gas burner 12 mounted on the outside of the casing 1 and arranged to fire into the immersion tube 9. The tube 9 may be provided with baffles 13 for extracting heat from the hot product gases flowing over them. A canopy deflector 14 is fitted over the immersion tube outlet 11 and a demister pad 15 is provided in an exhaust product gas outlet 16 at the top of the heater so as to remove any entrained water particles from the exhaust gases. A calorifier 17 in the form of a coiled tube located in the reservoir 4 and around the immersion tube 9 provides hot water for space heating. A further calorifier 18 similarly located in the form of a spirally coiled tube, conveniently fed with mains pressurised or locally pumped water, provides hot water, e.g., for a shower bath.

The water distribution plate 5 is in the form of a shallow metal tray having numerous substantially equispaced apertures 19, each of which is formed with an upstanding rim. In this way recirculated feed water from the pipe 6 will collect in the troughs around the rimmed apertures 19 and eventually spill over the rims in weir-like manner through the apertures to produce an evenly distributed flow of water droplets into the saturator unit 8.

The saturator unit 8 consists of a generally pan-shaped metal container 21 with a perforate base 22 filled with a packed bed of graded solid particles Rashig rings 23 formed from, for example, stainless steel, glass, aggregate or any suitable heat and corrosion resistant material over and through which the feed water from the distribution plate 5 passes. Where it is desired to reduce the nitrate and nitrite levels of the water being drawn off from the reservoir 4, suitable chemicals may be added to or mixed with the bed of particles 23. Chemicals such as anion exchange resins would be suitable, for example, 'Amberlite' IRA 410 (Registered Trade Mark) which is made up of a cross-linked polystyrene-divinylbenzene matrix incorporating a strongly basic active group, e.g., quaternary ammonium salt ($R_4N^+Cl^-$) in the form of a chloride and in which R is an alkyl group.

The numbers and size of the apertures and perforations in the plate 5 and container base 22 and the geometrical shape of the bed of solid particles or Rashig rings 23 will depend on a number of factors involving heater capacity, water flow rate, burner flow rate, wettable surface areas, product gas pressure and required efficiency.

In operation of the water heater, the premixed gas burner 12 fires hot combustion product gases into the immersion tube heat exchanger 9 which is designed to indirectly exchange a substantial part of the available heat from the burner's hot combustion product gases to the surrounding water reservoir 4. The gases will leave the tube 9 through the outlet 11 at a relative low temperature of between 100°-150° C. The canopy 14 shields the outlet from falling water and may assist in the upward distribution of product gases. These hot gases then travel upwardly, impinging upon and passing through the apertures in the perforate base 22, over the Rashig rings 23, and through the distribution plate 5 so as to be in direct heat exchange contact with the streams of water droplets flowing in a counter flow direction. By the time the product gases reach the top of the heater, most of the available heat has been removed and the product gases leave the flue outlet 16 at a few degrees centigrade above the feed water inlet temperature.

A water heater in accordance with the invention having a compact saturator unit as aforesaid has the advantage of providing a high wettable surface area, in the minimum of space, for the maximum exchange of heat from the hot gases to the feed water passing over the closely packed saturator materials and with a minimal pressure drop of the hot gases. With this arrangement, the size of the middle heat transfer section of the heater described in U.S. Pat. No. 4,530,347 is considerably reduced. This enables the presently invented heater to employ a larger capacity reservoir of hot water and associated calorifiers without necessarily increasing the overall size of the heater.

In a test of a typical gas-fired water heater in accordance with that described and shown with reference to the drawing, the performance data was as follows:

Rated Input Gas: 7.9 kW
Feed Water Inlet: 47° C.
Feed Water Flow Rate: 250 liters/hour
Flue exhaust gas temperature: 49° C.

This corresponds to an overall heater efficiency in excess of 91% based on the gross calorific value of the fuel gas. The overall efficiency of a heater in accordance with the invention is only marginally reduced as the water outlet temperature is raised.

We claim:

1. In a compact, gas-fired water heater which comprises a casing that defines a reservoir for collecting water; a water inlet pipe connected to said casing to supply cold water to said reservoir; a water outlet pipe connected to said casing to remove heated water from said reservoir; a heat exchanger means located within said casing which extends upwardly through said reservoir to an outlet opening above a normal water level in said reservoir; a gas burner for supplying heated combustion gases to the interior of said heat exchanger means; a deflection canopy located within said casing and above the outlet opening of said heat exchanger means; a distribution means located in said casing above both said normal water level in said reservoir and said deflection canopy for providing a plurality of downwardly falling streams of water; water supply means for supplying water to said distribution means; a heat transfer means located in said casing below said distribution means and above both said normal water level in said reservoir and said deflection canopy; and an exhaust gas outlet means located above said water distribution means;

the improvement wherein said heat transfer means comprises a generally pan-shaped metal container having a perforated base and containing a plurality of solid materials in the form of a packed bed, said solid materials including inert materials and an anion exchange resin; and wherein said water heater includes a calorifier for heating a stream of water passing therethrough, said calorifier comprising a first tube portion which extends through said casing and into said reservoir, a second tube portion which is connected to said first tube portion and is coiled around said heat exchanger means, and a third tube portion which is connected to said second tube portion and extends through said casing and out of said reservoir.

2. The compact, gas-fired water heater as defined in claim 1, wherein said inert materials comprise graded solid particles.

3. The compact, gas-fired water heater as defined in claim 2, wherein said graded solid particles comprise stainless steel.

4. The compact, gas-fired water heater as defined in claim 2, wherein said graded solid particles comprise glass.

5. The compact, gas-fired water heater as defined in claim 1, wherein said inert materials comprise Rashig rings.

6. The compact, gas-fired water heater as defined in claim 1, wherein said anion exchange resin comprises a cross-linked polystyrene-divinylbenzene matrix incorporating a strongly basic active group.

7. The compact, gas-fired water heater as defined in claim 6, wherein said strongly basic active group consists of a quarternary ammonium chloride salt, $R_4N^+Cl^-$, wherein R is an alkyl group.

* * * * *